US005993019A

United States Patent [19]

Kline et al.

[11] Patent Number: 5,993,019

[45] Date of Patent: Nov. 30, 1999

[54] MOLDED TWO PART BUTTON WITH ILLUMINATED GRAPHIC

[75] Inventors: Kerry J. Kline, Kokomo; Edgar Glenn Hassler, Sharpsville, both of Ind.

[73] Assignee: Delco Electronics Corporation, Kokomo, Ind.

[21] Appl. No.: 08/943,704

[22] Filed: Oct. 3, 1997

[51] Int. Cl.[6] ..... F21Q 3/00

[52] U.S. Cl. ..... 362/29; 362/302; 200/314

[58] Field of Search ..... 200/314, 315, 200/316; 362/23, 22, 30, 95, 351

[56] References Cited

U.S. PATENT DOCUMENTS 5,036,440 7/1991 Takii et al. ..... 362/29
5,510,782 4/1996 Norris et al. ..... 200/214
5,536,543 7/1996 Papandreou ..... 200/314
5,718,326 2/1998 Larose et al. ..... 200/314

*Primary Examiner*—Thomas M. Sember
*Attorney, Agent, or Firm*—Jimmy L Funke

[57] ABSTRACT

A backlighted button or knob made by multi-shot molding has a translucent part and an opaque part. At the front of the button the translucent part contains a ridge shaped in the form of a symbol which is illuminated. The opaque part surrounds the ridge to mask light to surrounding areas. Where the symbol is a closed figure defining an island, a passage behind the ridge coupled the island to the surrounding areas to allow opaque material to flow to the island during molding, and results in an opaque bridge in the passage. To minimize a shadow of the bridge on the illuminated symbol the bridge is spaced far behind the ridge to allow light to be conducted through the translucent material to the ridge portion just in front of the bridge.

1 Claim, 2 Drawing Sheets

MOLDED TWO PART BUTTON WITH ILLUMINATED GRAPHIC

FIELD OF THE INVENTION

This invention relates to an illuminated button and particularly to a two part molded button with reduced shadow effects.

BACKGROUND OF THE INVENTION

In electronic controls such as automotive radios and the like, control knobs or buttons bearing graphics such as letters, numbers and other symbols are often illuminated to make the graphics easily visible. An inexpensive method of making such buttons of good quality is by a two part molding process. A first shot of translucent material is injected into a mold to form a base part containing a raised symbol. A second shot of opaque material is injected to surround the symbol. The resulting button when back lighted will have the raised symbol illuminated and the remainder of the button will be dark due to the layer of opaque material.

Some symbols such as A, B and D are closed figures which define inner islands containing opaque material separate from the remainder of the button surrounding the graphic. The opaque material is fed to the island during the second shot by a bridge behind a portion of the raised symbol which connects the island with the area surrounding the symbol. Heretofore, this has resulted in the button typified by that shown in FIGS. 1, 2, 3 and 4. A button 10 bears the letter "A" having two angled side legs 14 and a cross bar 16 to define an island 18 which is isolated from the outer region 19 of the button outside the legs and crossbar. The base 20 of the button 10, shown in FIG. 2, is a cup-shaped element made of translucent material. The base has a front base surface 22 carrying a ridge 24 shaped to form the letter "A" which extends from the front base surface 22 to the front button surface 26. The inner wall of the button comprises a rear base surface 28. A lamp 30 mounted on a circuit board 32 or other light source behind the button illuminates the rear base surface so that the letter "A" is illuminated. An aperture 34 in the base extends transverse to and underneath the crossbar 16. To provide contrast and to suppress light through the front of the button other than through the illuminated symbol, an opaque part 36 is added to the button by injection molding so that the two parts together form a smooth uninterrupted front button surface 26. The opaque material during molding surrounds the letter "A" and flows through the aperture 34 to fill the island 18. The resulting opaque bridge 38 filling the aperture 34 impedes the flow of light to the portion of the crossbar 16 adjacent the bridge thereby causing a shadow on the light bar which is aesthetically objectionable.

SUMMARY OF THE INVENTION

It is therefore an object of the invention to reduce the shadow in a two part illuminated button having an opaque bridge to an island defined by a closed figure. Another object is to improve the structure of an illuminated button made by a two shot molding method for more uniform symbol illumination.

The prior art button is modified by placing the bridge path farther to the rear of the ridge defining the symbol so that it extends behind the rear base surface. This allows the portion of the ridge adjacent the bridge to be much larger to conduct more light to that portion, greatly reducing the shadow cast by the bridge.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

It will be apparent that the button referred to herein may well be a knob or other illuminated graphic which is beneficially made by multi-shot molding. The drawings of the invention use the same numerals used in prior art FIGS. 1–4 except that primes are added to features which differ from the prior art.

Figure 1:
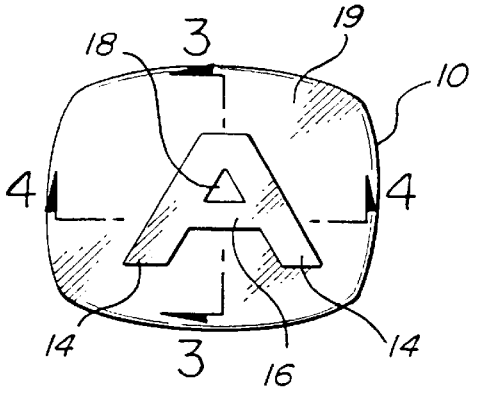
FIG-1 PRIOR ART
FIG. 1 is a front view of an illuminated button according to the prior art.
Figure 2:
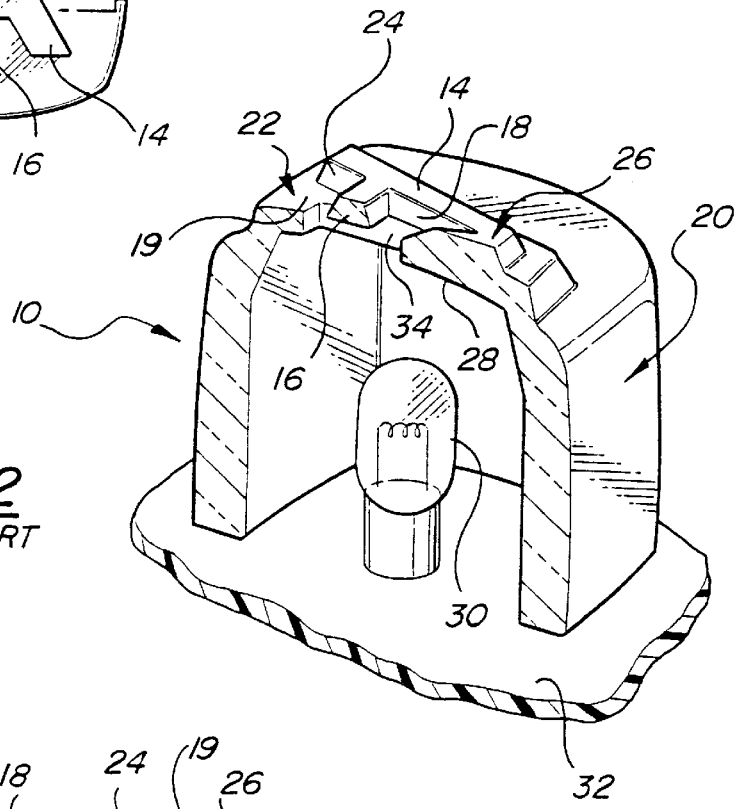
FIG-2 PRIOR ART
FIG. 2 is a partially broken away isometric view of the translucent part of the button of FIG. 1 along with back-lighting means.
Figure 3:
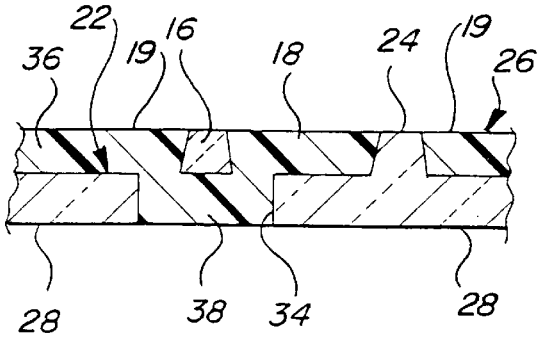
FIG-3 PRIOR ART
FIGS. 3 and 4 are cross sections of the button taken along lines 3—3 and 4—4 of FIG. 1, respectively.
Figure 4:
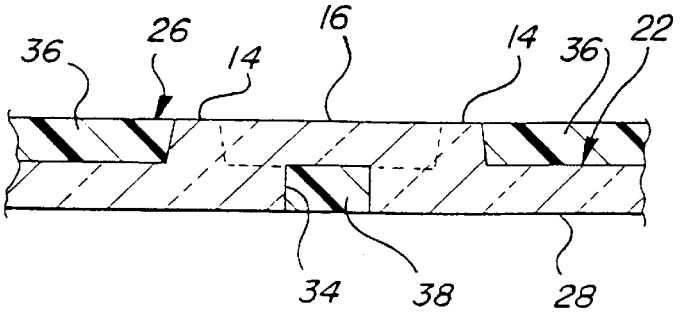
FIG-4 PRIOR ART
Figure 5:
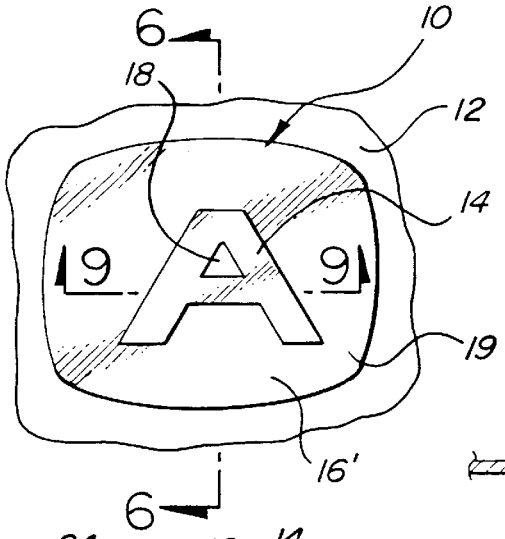
FIG. 5 is a front view of an illuminated button assembly according to the invention.

Referring to FIG. 5, a button 10' has the same illuminated graphic features described in FIG. 1 and is the same in outward appearance except for more uniform illumination due to reducing the shadow cast by the opaque bridge 38'. As shown in FIGS. 6–9 the ridge portion of the cross bar 16' in the region of the bridge 38' is made deeper, nearly twice as deep as in the prior art version shown in FIG. 1. The bridge 38' then extends back behind the rear surface 28 of the base to form a flow path around the cross bar 16', connecting the island 18 with the outer region 19 outside the symbol. A comparison of FIGS. 4 and 9 reveals how light (shown by arrows) conducted through the translucent base 20' more readily reaches the cross bar to reduce the shadow of the bridge. Measurements of light transmission using a Hoffman sphere show that in the shadow region of the FIG. 1–4 device the light is reduced 91%, and in the corresponding region of the button according to the invention the light is reduced only 45%. This improved illumination is sufficient to spell the difference between a product which is commercially successful and one which is rejected.

Figure 6:
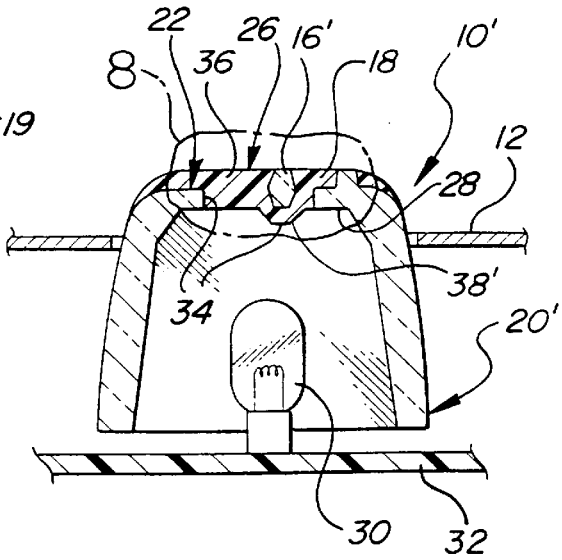
FIG. 6 is a cross section of the button assembly taken along line 6—6 of FIG. 5.
Figure 7:
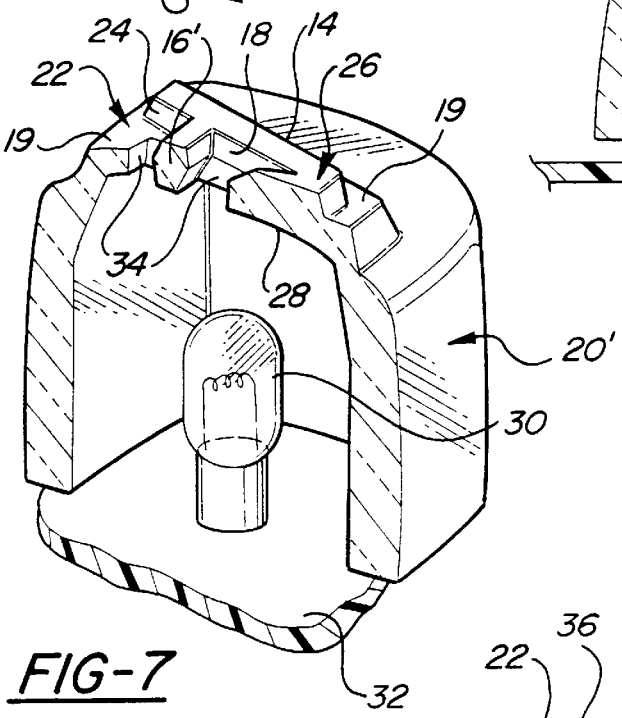
FIG. 7 is a partially broken away isometric view of the translucent part of the button of FIG. 5 along with back-lighting means.
Figure 8:
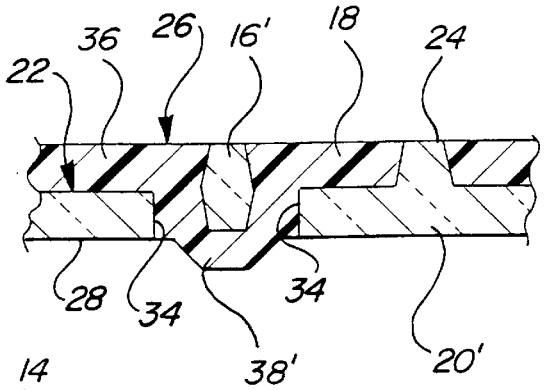
FIG. 8 is an enlarged view of area 8 of FIG. 6.
Figure 9:
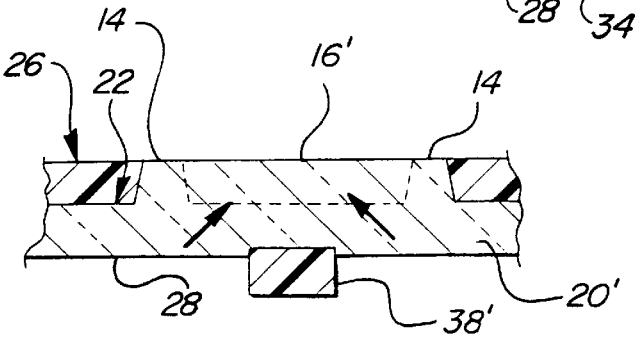
FIG. 9 is a cross section of the center region of the button taken along lines 9—9 of FIG. 5.

In general, the button assembly shown in FIGS. 5 and 6 includes the button 10' mounted in an aperture of a trim plate 12 and in front of back lighting means such as a lamp 30 on a circuit board. As in the prior art, the letter "A" has legs 14, a modified cross bar 16' and an island 18. The improved structure is indicated in FIG. 6 but is more clearly shown in FIGS. 7–9.

It will thus be seen that the modified bridge element vastly improves the uniformity of illumination of button graphics and yet adds no cost to the manufacture. Only a slight tooling modification is needed to change the shape and the path of the bridge.

The embodiments of the invention in which an exclusive property or privilege is claimed are defined as follows:

1. A molded button including a light transmissive member having a back surface exposed to a light source and a front surface facing a viewer, with one or more contiguous ridges protruding from said front surface to form a raised symbol on said front surface, said ridges dividing said front surface into an inner island region and an outer region, and an opaque material molded on said front surface, excluding said ridges, so that light from said light source passes through said ridges to said viewer, the improvement wherein:

said light transmissive member includes first and second apertures formed between said front and back surfaces in said inner island and outer regions, respectively; and said opaque material fills said first and second apertures and a bridge portion bridging said first and second apertures, said bridge portion protruding from the back surface of said light transmissive member so as to minimize a shadow cast on said ridges by the bridge portion of said opaque material.

* * * * *